United States Patent [19]

Vegiard

[11] 4,142,540

[45] Mar. 6, 1979

[54] WASH SHIELD FOR PAINT ROLLER

[76] Inventor: Lucien Vegiard, 5921 46th Ave. North, Kenneth City, Fla. 33709

[21] Appl. No.: 842,601

[22] Filed: Oct. 17, 1977

[51] Int. Cl.[2] ..... B08B 3/02

[52] U.S. Cl. ..... 134/138; 134/183

[58] Field of Search ..... 134/138–139, 134/149, 182–183, 135

[56] References Cited

U.S. PATENT DOCUMENTS

| | | | |
|---|---|---|---|
| 3,075,534 | 1/1963 | Habostad | 134/149 X |
| 3,126,899 | 3/1964 | Caywood | 134/149 X |
| 3,577,280 | 5/1971 | George | 134/138 |

FOREIGN PATENT DOCUMENTS

| | | | |
|---|---|---|---|
| 250197 | 9/1926 | Italy | 134/135 |

*Primary Examiner*—Robert L. Bleutge
*Attorney, Agent, or Firm*—Walter J. Monacelli

[57] ABSTRACT

The wash shield disclosed herein comprises a sheet material in substantially cylindrical shape having a slot running parallel to the axis of the cylinder, in which cylindrical shape a paint roller is enclosed while a stream of wash water is directed to the surface of the roller for the purpose of removing paint therefrom. The cylindrically shaped sheet has a cover at one end of the cylinder which is at the top when the cylinder is held in a vertical position, and the opposite end or bottom end is open and extends at least several inches beyond the end of the roller contained therein. Between the cover and the main body of the cylinder there is another slot, in a horizontal position when the cylinder is held vertically, into which slot the handle of the roller will fit and rest on the cylinder body while the roller is being washed. The force of the wash stream rotates the roller very rapidly and the resultant centrifugal force throws the wash water and accompanying paint away from the roller and against the interior of the cylindrical shield and from there the wash liquid falls vertically and out the open end of the shield.

1 Claim, 8 Drawing Figures

FIG. 1
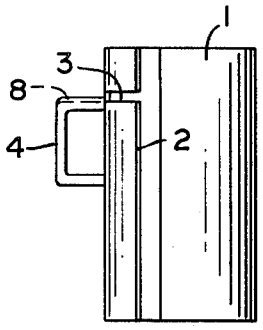
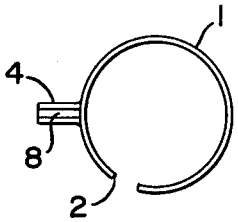
FIG. 2
FIG. 3
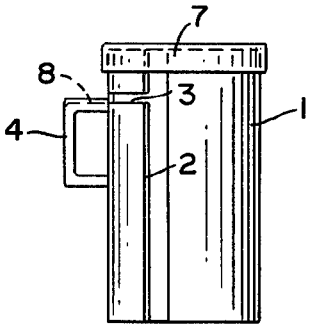
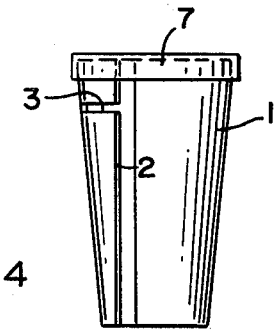
FIG. 4
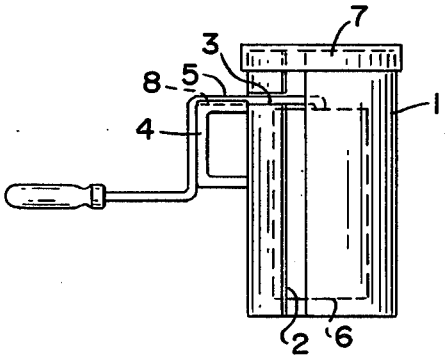
FIG. 5
FIG. 6
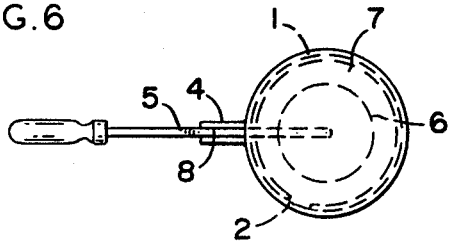
FIG. 7
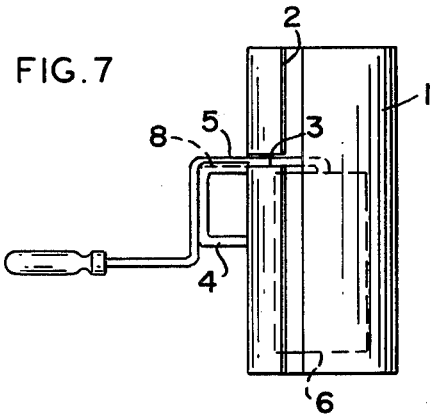
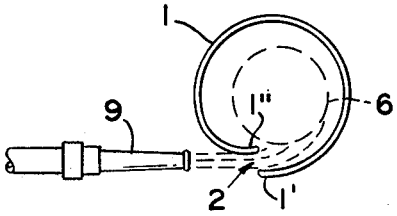
FIG. 8

WASH SHIELD FOR PAINT ROLLER

BACKGROUND OF THE INVENTION

1. Field of the Invention

This invention relates to a shield device used in washing paint off a roller after the roller has been used in applying paint to a surface. More specifically, the shield device protects against the wash water and removed paint from spraying onto surrounding surfaces while the paint is being removed by directing a stream of wash water against the roller surface.

2. State of the Prior Art

In washing the paint off a paint roller after the painting is finished, the roller is either immersed several times in a bucket or buckets of water or a stream from a water hose is directed against the roller while the roller is held in an open area where the resulting spray will not harm the surroundings. These methods are rather messy and, in some cases, the worker prefers to discard the roller without going through the cleaning process. Consequently, if the worker does not wish to go through the messy cleaning operation, he has to use a new roller for the next painting operation.

U.S. Pat. No. 3,825,970 describes a paint roller frame with spray shield and clean-up means. This device has a shield attached to the handle which protects against spraying paint while the roller is being rotated against the surface being painted. This is designed primarily for the painting operation and the sides of the shield have openings therein in which the ends of the axle of the roller are inserted and supported.

Patentee indicates that this shield may be used in a washing operation by directing a water hose against the roller and having the resultant spray from the revolving roller directed against the shield. However the shield covers only half of the roller and such an operation will result in half of the spray not being intercepted. To overcome this defect, patentee suggests that his device may be used in combination with "a spray box" by laying his device on the open top of the spray box whereby multiple jets from the spray box will be directed against the roller and thereby wash the paint from the roller. However, this requires a separate complex piece of equipment. Moreover, this requires the shield device of the patent which may not be available and which may not be desired by anyone not concerned with the small amount of spraying that may occur during painting.

It is desirable therefore that a simple device should be available into which the paint roller may be inserted and washed simply by directing a stream from a water hose against the roller.

STATEMENT OF THE INVENTION

In accordance with the present invention, it has now been found that the washing of a paint roller may be very simply, quickly and efficiently effected by a device comprising a sheet material, such as metal, plastic, etc., shaped in substantially cylindrical form, having a slot parallel to the axis of the cylinder through which the handle of the roller may be passed when the roller is being inserted into the cylinder. This slot is sometimes referred to as the "vertical" slot since the axis of the cylinder is generally in a vertical position during use. The cylinder advantageously has a cover at one end thereof and the opposite end is advantageously open or at least has an exit for the wash liquid. At or near the end of the cylinder at which the cover is attached there is a slot running perpendicularly from the first or "vertical" slot and this may be referred to as the "horizontal" slot since it is generally in a horizontal position during use.

When a paint roller is to be cleaned, the device may be held in a vertical position and the narrow part of the handle fitted into the vertical slot while the roller is raised vertically into the interior of the cylindrical shape. When the narrow part of the handle reaches the point where the vertical slot is joined by the horizontal slot, the handle is moved horizontally into that slot and rested on the edge of the horizontal slot. Then a stream of water is directed at the roller through the vertical slot. The force of the stream striking the roller tangentially causes the roller to rotate rapidly, thereby throwing water and paint by centrifugal force off the roller and onto the interior surface of the cylindrically shaped shield. After the impact of the liquid against the cylinder wall, the liquid falls vertically toward the open or exit end of the device.

The cylinder may have a handle attached thereto so that it may be held in one hand while the other hand holds the water hose. Advantageously the shield handle is attached vertically with one end of the handle near the horizontal slot. In this way the narrow part of the paint roller handle emerging through the horizontal slot may be pressed by the holder's thumb or finger against the shield handle. This permits the roller to be held rigidly during its rapid rotation. For this purpose the shield handle may have a groove at the top or side thereof into which the roller handle portion may be pressed.

If desired, the shield handle or similar holding device may be clamped to any appropriate holding means so that the cylinder and the roller handle may be held firmly during the washing operation.

Alternatively, the device may be used without a handle and the device fitted tightly into an opening in a horizontal sink such as a table top or a board or top on a sink so that the device is held rigidly in the opening and the wash liquid emptied below the surface embracing the device, such as in a sink or drain.

Advantageously also one or both edges of the vertical slot may be turned inwardly to catch or impede any small amount of spray that might exit through the slot, particularly if the slot is made of any considerable width.

The device of this invention may be further described by reference to the drawings in which:

FIG. 1 is a front elevational view of one modification of the device of this invention without a top cover;

FIG. 2 is a top plan view of the modification of FIG. 1;

FIG. 3 is a front elevational view of the device of FIG. 1 with a top cover;

FIG. 4 is a front elevational view of a modification in which the substantially cylindrical shape is tapered somewhat to give a narrower bottom portion;

FIG. 5 is a front elevational view of the modification of FIG. 3 in which a paint roller has been inserted into the device;

FIG. 6 is a top plan view of the modification of FIG. 5;

FIG. 7 is a front elevational view of a modification having no top cover but having its top section extended to a height that will minimize spray emanating therefrom;

FIG. 8 is a top plan view (minus cover) in which the edges of slot 2 are distorted somewhat from a true cylindrical shape;

In FIGS. 1–6 the substantially cylindrical shape 1 has vertical slot 2 and horizontal slot 3. Handle 4 is attached to the cylindrical surface so that its upper portion is near slot 3 so that the roller arm 5 of the paint roller 6 may rest on or be pressed against the handle. In FIGS. 3–6, a cover 7 is provided. FIG. 4 shows a slight taper in the cylindrical shape so that it may be fitted into an opening as described above. FIG. 6 shows a groove 8 in the top of handle 4 in which the roller arm 5 may rest and be pressed against the handle.

The modification shown in FIG. 7 has no top cover but is extended upward a substantial distance compared to the other modifications. In this way, even without the top cover, the spray from the roller is unlikely to escape without hitting the cylindrical surface. In this modification the roller handle arm 5 is shown in horizontal slot 3 and resting on shield arm 8. This may be modified by omitting the horizontal slot 3 and substituting a vertical slot parallel to slot 2 and extending from the top of the shield arm 8 to the top of the shield. In this way the paint roller may be lowered into the interior of the shield with the roller handle arm being lowered into this second vertical slot and brought to rest on the shield handle 8 similar to the manner presently shown in FIG. 7.

FIG. 8 shows a modification in which the edges of slot 2 are distorted, edge 1′ being turned slightly outward and edge 1″ being slightly inwardly from a true cylindrical configuration. Dotted section 6 represents the position the roller will occupy. Water nozzle 9 is positioned so that a stream of water will be jetted through slot 2 against the roller. This positioning of the slot edges makes it even more difficult for spray to escape.

Preferably the shield has a cover as shown in FIGS. 3–6. This cover may be removable as shown or may be permanently affixed.

The cylindrical shape may be made of various suitable materials such as metal, plastic, glass, impregnated paper, etc. The device may be of various sizes to accommodate a particular size of roller or may be of large enough size to accommodate the largest sized rollers, in which case even smaller rollers may still be used in the device. The device may be molded in one piece including the shield, top and handle as one integral molding, or the shield and top may be molded as one piece and the handle attached.

The inside of the cover or top may be designed with a groove and stop in the interior surface thereof (not shown) so that the roller handle arm may be fitted into and held therein.

Advantageously the paint roller is centered within the shield or otherwise positioned so that the stream of water directed into the vertical slot strikes the roller tangentially and thereby rotates the roller.

In washing paint rollers in this device, the water stream is initially directed to the top (vertically) of the roller and gradually moved downward to the bottom of the roller. The paint is removed quickly and efficiently by both the washing action and the centrifugal force of the rapidly rotated roller. Generally this may be effected in only a few minutes to such a degree that the roller is substantially completely cleaned of paint.

This device is very simple and easy to handle and to operate. The paint roller may be inserted and cleaned without disassembling the roller and the device may be used in the home, for example in a kitchen or bathroom sink. Moreover, the paint roller may be retained in the device for storage or transportation.

While reference has been made to water washing of the roller, obviously for latex paints, this device may also be used on oil paints using a solvent suitable for oils or with an aqueous solution containing sufficient detergent or emulsifying agent therein to remove the oil paint.

While certain features of this invention have been described in detail with respect to various embodiments thereof, it will of course be apparent that other modifications can be made within the spirit and scope of this invention, and it is not intended to limit the invention to the exact details shown above except insofar as they are defined in the following claims.

The invention claimed is:

1. A shield for the washing of a paint roller comprising (a) a sheet material shaped in substantially cylindrical form having a first slot and a second slot therein, said first slot running substantially parallel to the linear axis of said cylindrical form and said cylindrical form having a length extending beyond the length of the paint roller to be washed, said first slot having a width sufficient to accommodate the passage of the narrowest portion of the roller arm and to permit the passage of a wash stream therethrough whereby said wash stream impinges tangentially on said roller and rotates and washes paint from said roller, said second slot being positioned near one end of said cylindrical form and running perpendicularly from said first slot and only a short distance around the curved surface of said cylindrical form, said second slot being adapted to accomodate the handle arm of said paint roller during washing, (b) a handle attached to said cylindrically formed sheet material and positioned adjacent to said second slot, said handle being adapted to support said shield and to have the paint roller handle pressed into contact therewith and thereby to hold and support said roller during the washing operation; and (c) and end plate closing said cylindrical form of said shield at the end adjacent to said second slot, with the opposite end being open to allow the flow of wash water from said shield.

* * * * *